US010035671B2

(12) United States Patent
Tashiro et al.

(10) Patent No.: US 10,035,671 B2
(45) Date of Patent: Jul. 31, 2018

(54) IMAGE FORMING APPARATUS

(71) Applicant: KYOCERA Document Solutions Inc., Osaka (JP)

(72) Inventors: Yoshiaki Tashiro, Osaka (JP); Hideaki Doyo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/550,906

(22) PCT Filed: Mar. 31, 2016

(86) PCT No.: PCT/JP2016/060640

§ 371 (c)(1),
(2) Date: Aug. 14, 2017

(87) PCT Pub. No.: WO2016/163298

PCT Pub. Date: Oct. 13, 2016

(65) Prior Publication Data

US 2018/0029812 A1 Feb. 1, 2018

(30) Foreign Application Priority Data

Apr. 6, 2015 (JP) ..... 2015-077796

(51) Int. Cl.

| | |
|---|---|
| ***B65H 3/06*** | (2006.01) |
| ***B65H 3/56*** | (2006.01) |
| ***G03G 15/00*** | (2006.01) |
| ***B65H 5/02*** | (2006.01) |
| ***B65H 3/52*** | (2006.01) |

(52) U.S. Cl.

CPC ..... *B65H 3/0661* (2013.01); *B65H 3/0684* (2013.01); *B65H 3/52* (2013.01); *B65H 3/56* (2013.01); *B65H 5/025* (2013.01); *G03G 15/6511* (2013.01); *B65H 2801/06* (2013.01)

(58) Field of Classification Search

CPC ..... B65H 1/04; B65H 1/14; B65H 3/0661; B65H 3/0684; B65H 3/52; B65H 2405/115; B65H 2405/324; B65H 2405/354

USPC ..... 271/9.09

See application file for complete search history.

(56) References Cited

U.S. PATENT DOCUMENTS

2015/0061214 A1* 3/2015 Woo ..... B65H 3/0607 271/117
2015/0084268 A1* 3/2015 Lee ..... B65H 3/0684 271/117
2015/0123341 A1* 5/2015 Hirata ..... B65H 1/04 271/163

FOREIGN PATENT DOCUMENTS

JP 2013-086968 A 5/2013

* cited by examiner

*Primary Examiner* — David H Bollinger
(74) *Attorney, Agent, or Firm* — Studebaker & Brackett PC

(57) ABSTRACT

An image forming apparatus (1) includes an image forming device (5), a conveyor device (L), and a manual paper feed section (8). The conveyor device (L) conveys paper (P). A part of the conveyor device (L) is constituted by a conveyance guide unit (83) and an exterior unit (82). The exterior unit (82) is located opposite to the conveyance guide unit (83) and constitutes a part of an exterior surface of the image forming apparatus (1). The manual paper feed section (8) includes a paper feed roller (821) and a retard roller (831). The paper feed roller (821) is located in the exterior unit (82) and feeds paper (P) placed on a manual feed tray (81) to the conveyor device (L). The retard roller (831) is located in the conveyance guide unit (83) and separates sheets of the paper (P) fed by the paper feed roller (821).

6 Claims, 7 Drawing Sheets

IMAGE FORMING APPARATUS

TECHNICAL FIELD

The present invention relates to an image forming apparatus.

BACKGROUND ART

Various techniques have been known about a manual paper feeder located in an image forming apparatus.

For example, there has been disclosed an image forming apparatus in which a manual insertion unit that opens by rotating in a horizontal plane is located (see Patent Literature 1). The manual insertion unit is configured to expose a cassette-side guide member and a manual-insertion side guide member. Further, a positioning mechanism including a first urging member and a second urging member is located in the image forming apparatus. The first urging member urges the manual-insertion side guide member opened at the time of jam removal in a closing direction. The second urging member holds the manual-insertion guide member stationary at a predetermined position.

Patent Literature 1 discloses that according to the above image forming apparatus, occurrence of skewing and edge folding of recording paper can be reduced and conveyance performance can be improved in paper feeding from the manual insertion unit.

CITATION LIST

Patent Literature

[Patent Literature 1]
Japanese Patent Application Laid-Open Publication No. 2013-86968

SUMMARY OF INVENTION

Technical Problem

However, there is still room for improvement of the image forming apparatus disclosed by Patent Literature 1 in terms of space-saving since the image forming apparatus includes the manual insertion unit. That is, members constituting a manual paper feed mechanism are accommodated in a casing and located in the image forming apparatus. Therefore, a space for locating the manual insertion unit is occupied.

The present invention was made in view of the above problem and it is an object of the present invention to provide an image forming apparatus that can achieve space-saving around a manual paper feed mechanism.

Solution to Problem

An image forming apparatus of the present invention performs image formation on a recording medium and includes an image forming device, a conveyor device, and a manual paper feed mechanism. The image forming device forms an image on the recording medium. The conveyor device conveys the recording medium. The manual paper feed mechanism performs manual paper feeding. A part of the conveyor device is constituted by a conveyance guide unit and an exterior unit. The exterior unit is located opposite to the conveyance guide unit and constitutes a part of an exterior surface of the image forming apparatus. The manual paper feed mechanism is located in the conveyance guide unit or the exterior unit.

Advantageous Effects of Invention

According to the image forming apparatus of the present invention, space-saving can be achieved around the manual paper feed mechanism.

DESCRIPTION OF EMBODIMENTS

Figure 1:
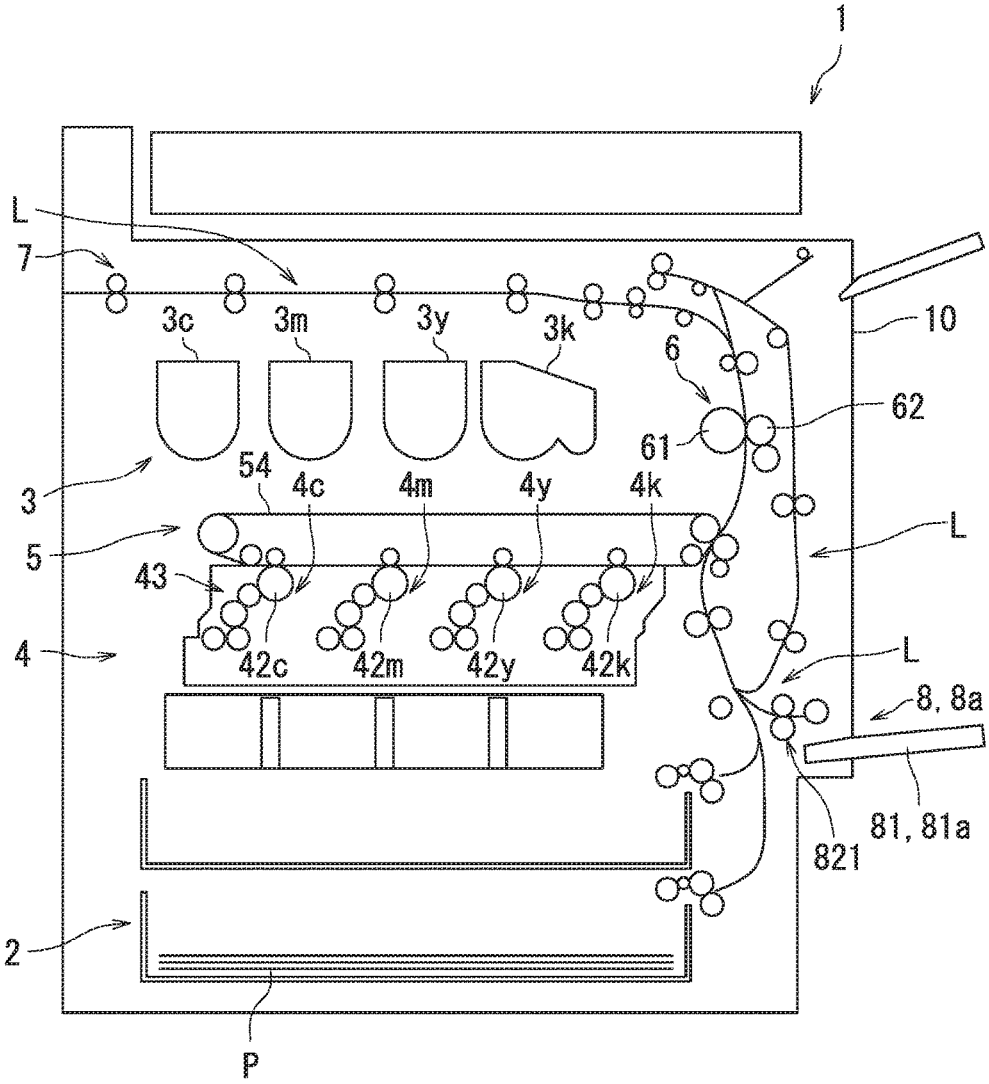
FIG. 1 is a side view illustrating a configuration of an image forming apparatus according to an embodiment of the present invention.

The following describes an embodiment of the present invention with reference to the drawings (FIGS. 1 to 7). It should be noted that elements in the drawings that are the same or equivalent are labelled using the same reference signs and description thereof is not repeated.

First, an image forming apparatus 1 according to the present embodiment will be described with reference to FIG. 1. FIG. 1 is a diagram illustrating a configuration of the image forming apparatus 1 according to the present embodiment. The image forming apparatus 1 of the present embodiment is a color copier.

The image forming apparatus 1 is an apparatus that performs image formation on paper P. and includes a housing 10, a paper feed section 2, a conveyor device L, a toner replenishing unit 3, an image forming device 4, a transfer section 5, a fixing section 6, an ejection section 7, and a manual paper feed section 8, as illustrated in FIG. 1.

The paper feed section 2 is located in a lower part of the housing 10 and feeds the paper P to the conveyor device L. The paper feed section 2 can accommodate plural sheets of the paper P and feeds the upper most sheet of the paper P to the conveyor device L sheet by sheet.

The conveyor device L conveys the paper P fed by the paper feed section 2 to the ejection section 7 through the transfer section 5 and the fixing section 6.

The toner replenishing unit 3 includes four toner cartridges 3*c*, 3*m*, 3*y*, and 3*k* that are containers for supplying toners to the image forming device 4. The toner cartridge 3*c* contains a cyan toner. The toner cartridge 3*m* contains a magenta toner. The toner cartridge 3*y* contains a yellow toner. The toner cartridge 3*k* contains a black toner.

In the following description, the toner cartridges 3*c*, 3*m*, and 3*y* may be referred to as color toner cartridges 31, and the toner cartridge 3*k* may be referred to as a black toner cartridge 32.

The transfer section 5 includes an intermediate transfer belt 54. The transfer section 5 transfers to the paper P toner images formed on the intermediate transfer belt 54 by the image forming device 4. A configuration of the transfer section 5 will be described further below with reference to FIG. 2. The transfer section 5 is a part of an "image forming device".

The image forming device 4 forms toner images on the intermediate transfer belt 54. Color toners and the black toner are supplied to the image forming device 4 from the respective color toner cartridges 31 and the black toner cartridge 32. Specifically, the image forming device 4 includes four image forming devices 4*c*, 4*m*, 4*y*, and 4*k*. The cyan toner is supplied from the toner cartridge 3*c* to the image forming device 4*c*. The magenta toner is supplied from the toner cartridge 3*m* to the image forming device 4*m*. The yellow toner is supplied from the toner cartridge 3*y* to the image forming device 4*y*. The black toner is supplied from the toner cartridge 3*k* to the image forming device 4*k*. A configuration of the image forming device 4 will be described further below with reference to FIG. 2.

The fixing section 6 fixes to the paper P toner images formed on the paper P by the transfer section 5. The fixing section 6 includes a heating roller 61 and a pressure roller 62. The heating roller 61 and the pressure roller 62 apply heat and pressure to the paper P. Through the above, the fixing section 6 fixes unfixed toner images transferred to the paper P by the transfer section 5. The fixing section 6 is a part of the "image forming device".

The ejection section 7 ejects the paper P having toner images fixed thereon out of the apparatus.

The manual paper feed section 8 includes a manual feed tray 81 and a paper feed roller 821. Paper P is placed on the manual feed tray 81 by a user. The paper feed roller 821 feeds the paper P placed on the manual feed tray 81 to the conveyor device L. The conveyor device L conveys the paper P fed by the paper feed roller 821 to the ejection section 7 through the transfer section 5 and the fixing section 6. The manual paper feed section 8 corresponds to a "manual paper feed mechanism".

Figure 2:
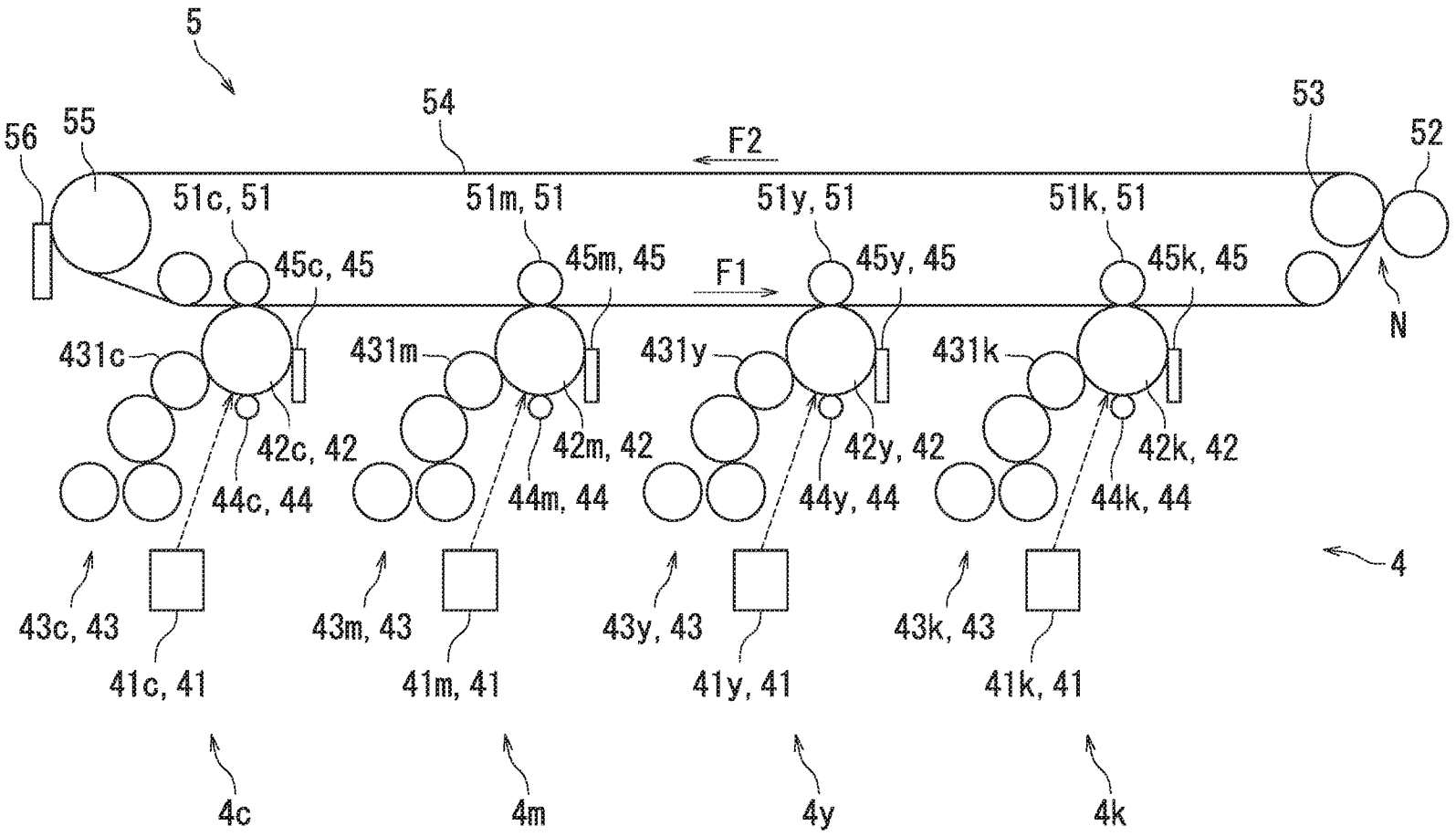
FIG. 2 is a side view illustrating configurations of an image forming device and a transfer section illustrated in FIG. 1.

Next, the configurations of the image forming device 4 and the transfer section 5 will be described with reference to FIG. 2. FIG. 2 is a side view illustrating the configurations of the image forming device 4 and the transfer section 5.

The image forming devices 4*c*, 4*m*, 4*y*, and 4*k* each include an exposure device 41, a photosensitive drum 42, a development section 43, a charging roller 44, and a cleaning section 45. The four image forming devices 4*c*, 4*m*. 4*y*, and 4*k* have substantially the same configuration. Therefore, in the present description, a configuration of the image forming device 4*c* to which the cyan toner is supplied is described, and description of configurations of the image forming devices 4*m*, 4*y*, and 4*k* other than the image forming device 4*c* is omitted.

The image forming device 4*c* includes an exposure section 41*c* (41), a photosensitive drum 42*c* (42), a development section 43*c* (43), a charging roller 44*c* (44), and a cleaning section 45*c* (45).

The charging roller 44*c* charges the photosensitive drum 42*c* to a specific potential. The exposure section 41*c* forms an electrostatic latent image on the photosensitive drum 42*c* by irradiating the photosensitive drum 42*c* with laser light. The development section 43*c* includes a development roller 431*c*. The development roller 431*c* develops the electrostatic latent image by supplying the cyan toner to the photosensitive drum 42*c* to form a toner image. Thus, a toner image in cyan is formed on the circumferential surface of the photosensitive drum 42*c*.

The cleaning section 45*c* removes the cyan toner remaining on the circumferential surface of the photosensitive drum 42*c*.

The transfer section 5 transfers toner images to the paper P (see FIG. 1). The transfer section 5 includes four primary transfer rollers 51 (51*c*, 51*m*, 51*y*, and 51*k*), a secondary transfer roller 52, a drive roller 53, the intermediate transfer belt 54, and a driven roller 55.

The transfer section 5 transfers to the intermediate transfer belt 54 respective toner images formed on the photosensitive drums 42 (42*c*. 42*m*. 42*y*, and 42*k*) of the respective image forming devices 4*c*, 4*m*. 4*y*, and 4*k* such that the toner images are superposed on one another, and then transfers the superposed toner images from the intermediate transfer belt 54 to the paper P (see FIG. 1).

The primary transfer roller 51*c* is located opposite to the photosensitive drum 42*c* with the intermediate transfer belt 54 therebetween. The primary transfer roller 51*c* can be brought into press contact with the photosensitive drum 42*c* with the intermediate transfer belt 54 therebetween or moved away from the photosensitive drum 42*c* by a driving mechanism not illustrated. The primary transfer roller 51*c* is normally in press contact with the photosensitive drum 42*c* with the intermediate transfer belt 54 therebetween. Similarly to the primary transfer roller 51*c*, the other primary transfer rollers 51*m*, 51*y*, and 51*k* are each in press contact with a corresponding one of the photosensitive drums 42 (42*m*, 42*y*, and 42*k*) with the intermediate transfer belt 54 therebetween.

The drive roller 53 is located opposite to the secondary transfer roller 52 and drives the intermediate transfer belt 54.

The intermediate transfer belt 54 is an endless belt stretched around the four primary transfer rollers 51, the drive roller 53, and the driven roller 55. The intermediate transfer belt 54 is driven by the drive roller 53 to circulate counterclockwise as indicated by arrows F1 and F2 in FIG. 2. The outer surface of the intermediate transfer belt 54 is in contact with the circumferential surfaces of the respective photosensitive drums 42 (42*c*, 42*m*, 42*y*, and 42*k*). Toner images are transferred from the photosensitive drums 42 (42*c*. 42*m*, 42*y*, and 42*k*) to the outer surface of the intermediate transfer belt 54 by the primary transfer rollers 51 (51*c*, 51*m*. 51*v*, and 51*k*).

The driven roller 55 is driven to rate in accompaniment with circulation of the intermediate transfer belt 54. A blade 56 is located at a position opposite to the driven roller 55 with the intermediate transfer belt 54 therebetween. The blade 56 removes toners remaining on the outer surface of the intermediate transfer belt 54.

The secondary transfer roller 52 is pressed against the drive roller 53. As a result, the secondary transfer roller 52 and the drive roller 53 form a nip part N therebetween. The secondary transfer roller 52 and the drive roller 53 transfer toner images from the intermediate transfer belt 54 to the paper P (see FIG. 1) while the paper P is passing through the nip part N.

Figure 3:
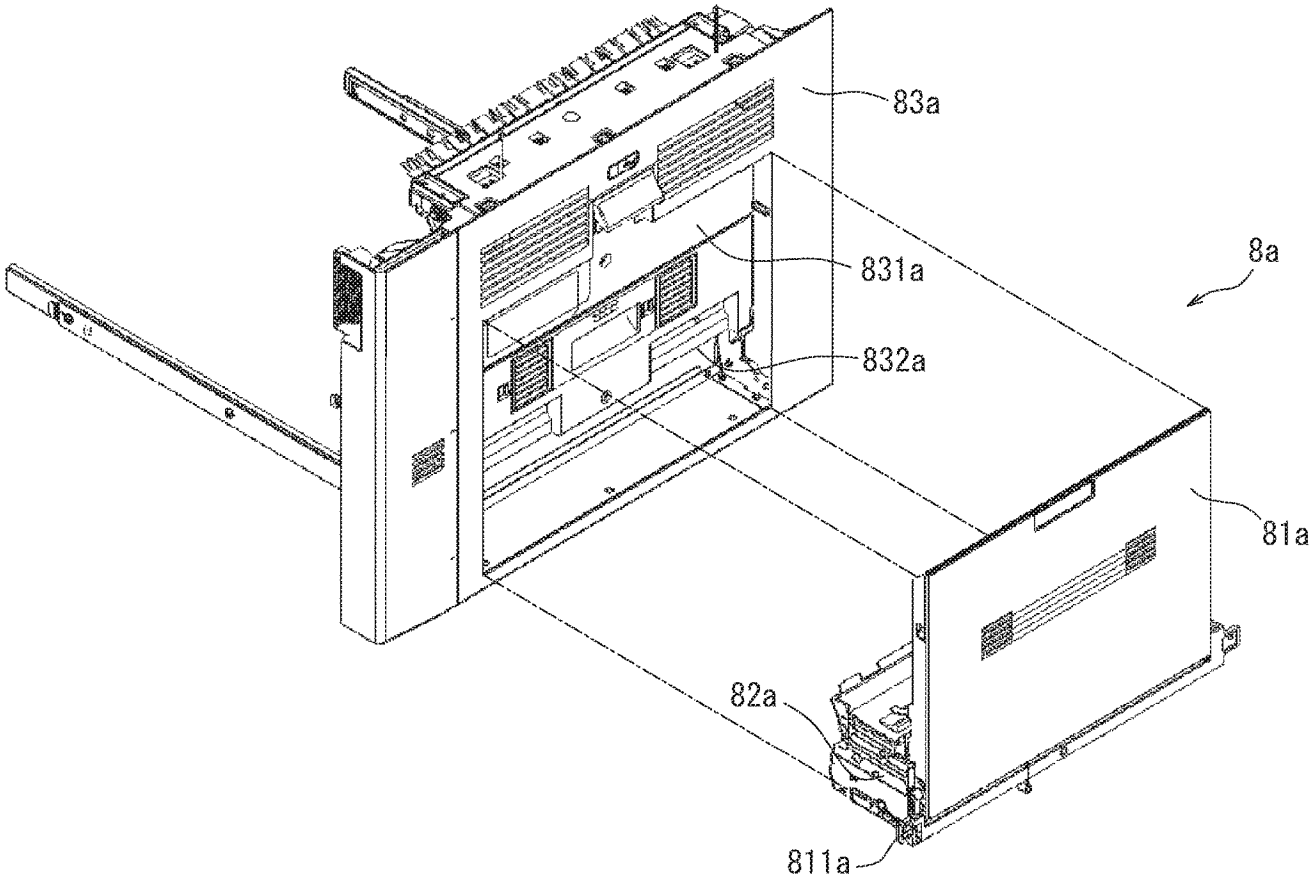
FIG. 3 is an exploded perspective view illustrating a configuration of a conventional manual paper feed section.

Next, a configuration of a conventional manual paper feed section 8*a* will be described with reference to FIG. 3. FIG. 3 is an exploded perspective view illustrating the configuration of the conventional manual paper feed section 8*a*. The manual paper feed section 8*a* includes a manual feed tray 81*a*, a manual paper feed unit 82*a*, and an exterior unit 83*a*. Paper P is placed on the manual feed tray 81*a* by a user.

The manual paper feed unit 82*a* includes a paper feed roller and a separating roller not illustrated and feeds the paper P placed on the manual feed tray 81*a* to the conveyor device L (see FIG. 1). The lower end of the manual feed tray 81*a* is turnably engaged with the manual paper feed unit 82*a*. FIG. 3 illustrates a position of the manual feed tray 81*a* when the manual paper feed section 8*a* is unused. When the manual paper feed section 8*a* is unused, the manual feed tray 81*a* is in an upright position as illustrated in FIG. 3 and serves as a part of an exterior surface. When the manual paper feed section 8*a* is to be used, the manual feed tray 81*a* is turned substantially 90 degrees clockwise about its lower end as a pivot axis to become substantially horizontal.

The exterior unit 83*a* is a part of the housing 10 illustrated in FIG. 1 (right side surface in FIG. 1). The exterior unit 83*a* includes a tray accommodating space 831*a* and a unit accommodating space 832*a*. The tray accommodating space 831*a* accommodates the manual feed tray 81*a*. The unit accommodating space 832*a* accommodates the manual paper feed unit 82*a*. The manual paper feed unit 82*a* is capable of feeding the paper P placed on the manual feed tray 81*a* to the conveyor device L illustrated in FIG. 1. while being accommodated in the unit accommodating space 832*a*.

As described above, members constituting a manual paper feed mechanism such as the paper feed roller and the separating roller were conventionally accommodated in a casing to constitute the manual paper feed unit 82*a*. Further, the manual paper feed unit 82*a* was located at a position opposite to the manual feed tray in the image forming apparatus 1. Therefore, a space for locating the manual paper feed unit 82*a* in the image forming apparatus 1 is occupied, and there was room for improvement in terms of space-saving around the manual paper feed mechanism.

Figure 4:
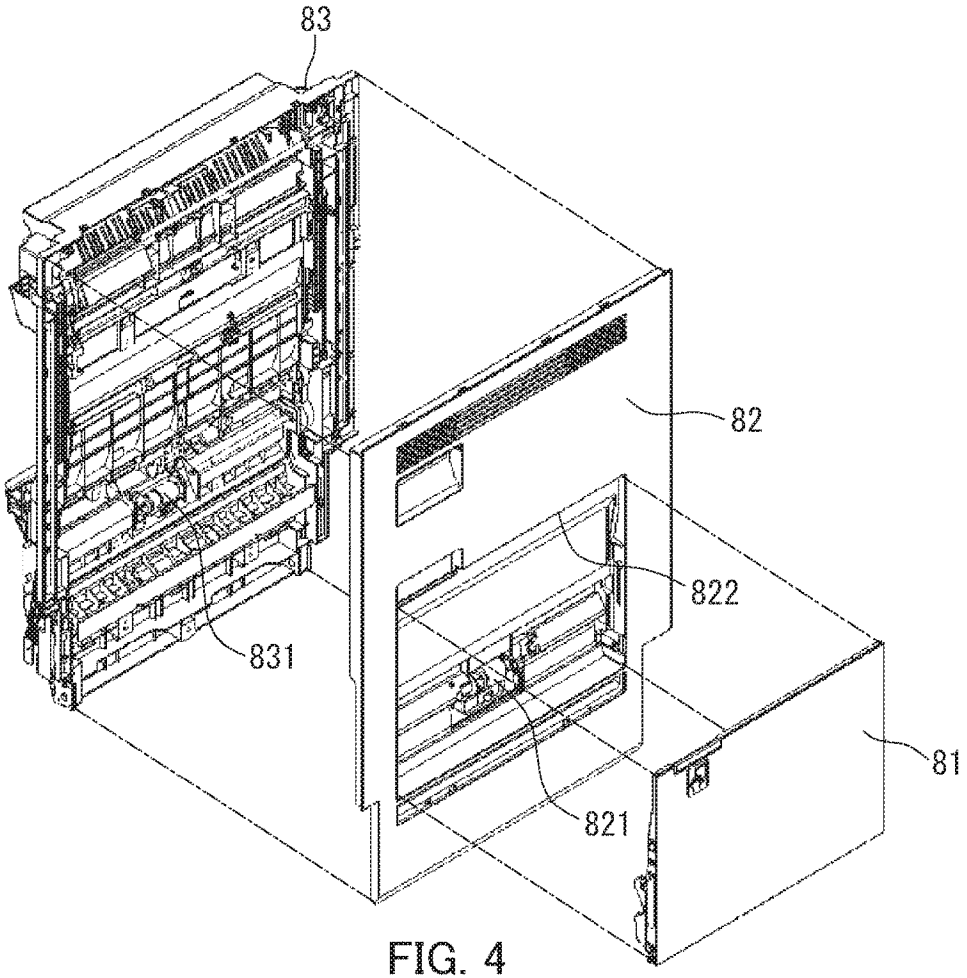
FIG. 4 is an exploded perspective view illustrating a configuration of a manual paper feed section illustrated in FIG. 1.

Next, a configuration of the manual paper feed section 8 according to the present invention will be described with reference to FIG. 4. FIG. 4 is an exploded perspective view illustrating the configuration of the manual paper feed section 8. The manual paper feed section 8 includes a manual feed tray 81, an exterior unit 82, and a conveyance guide unit 83. Paper P is placed on the manual feed tray 81 by a user.

The exterior unit 82 is located opposite to the conveyance guide unit 83 and constitutes the conveyor device L (see FIG. 1) and a part of an exterior surface of the housing 10 (a part of the right side surface in FIG. 1). The exterior unit 82 includes a paper feed roller 821 and a tray accommodating space 822. The paper feed roller 821 is driven to rotate by a motor not illustrated and feeds the paper P placed on the manual feed tray 81 to the conveyor device L illustrated in FIG. 1. The paper feed roller 821 is located at a position corresponding to a central part of the paper P in the width direction thereof. The paper feed roller 821 has a width smaller than that of the paper P.

The tray accommodating space 822 accommodates the manual feed tray 81. FIG. 4 illustrates a position of the manual feed tray 81 when the manual paper feed section 8 is unused. When the manual paper feed section 8 is unused, the manual feed tray 81 is in an upright position and serves as a part of the exterior surface as illustrated in FIG. 4. When the manual paper feed section 8 is to be used, the manual feed tray 81 is turned substantially 90 degrees clockwise about its lower end as a pivot axis to become substantially horizontal.

The conveyance guide unit 83 constitutes the conveyor device L (see FIG. 1) that conveys the paper P. The conveyance guide unit 83 includes a retard roller 831. The retard roller 831 separates sheets of the paper P fed by the paper feed roller 821 to prevent two or more sheets of the paper P from being conveyed while being superposed on one another. The retard roller 831 is located at a position corresponding to the central part of the paper P in the width direction thereof. The retard roller 831 has a width smaller than that of the paper P.

Figure 5:
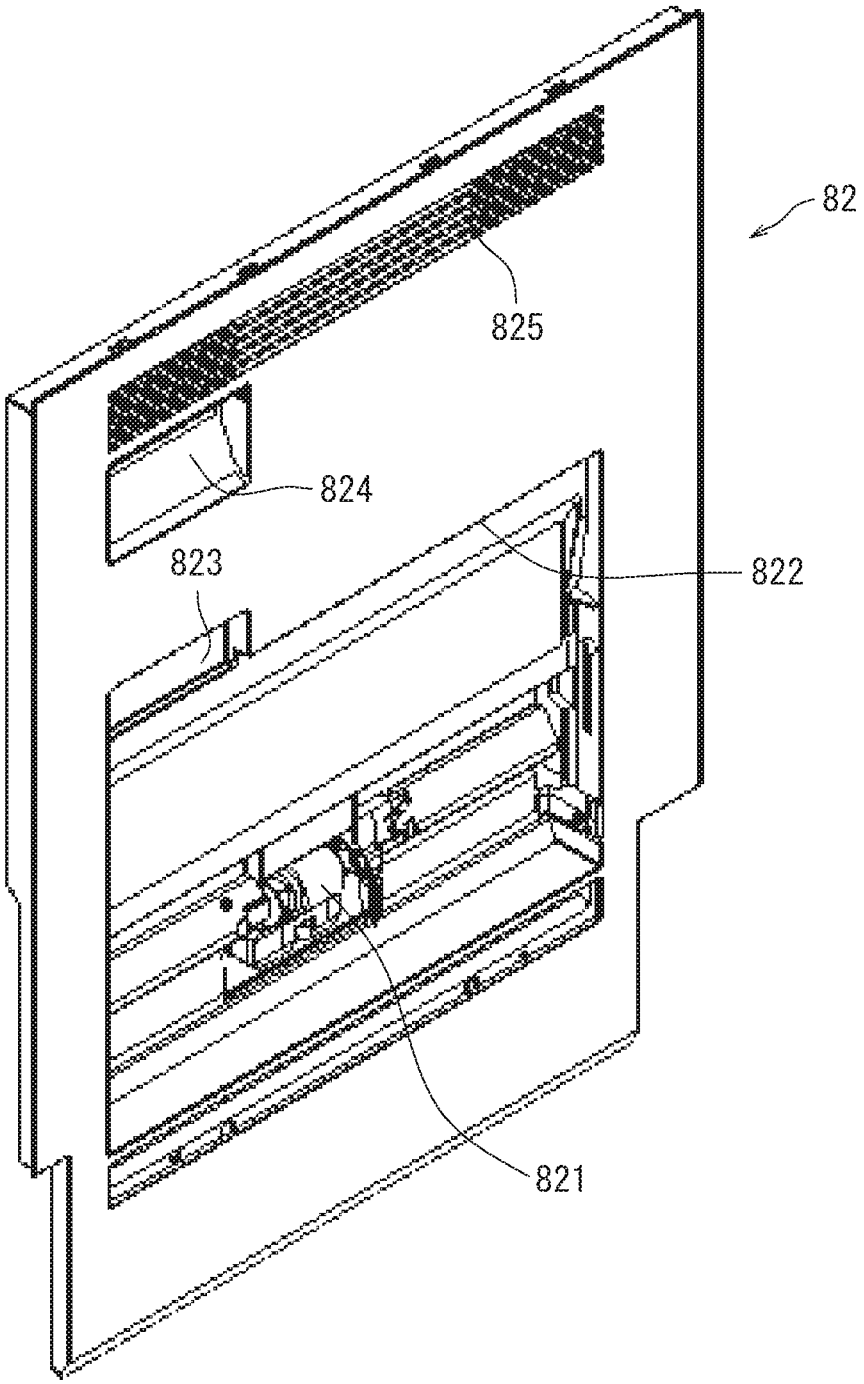
FIG. 5 is a perspective view illustrating a configuration of an exterior unit illustrated in FIG. 4.

Next, a configuration of the exterior unit 82 will be described with reference to FIG. 5. FIG. 5 is a perspective view illustrating the configuration of the exterior unit 82. The exterior unit 82 includes a recess 823, a handle portion 824, and an opening 825 in addition to the paper feed roller 821 and the tray accommodating space 822.

The recess 823 is located above the tray accommodating space 822, and a user's hand is inserted into the recess 823 to change the manual feed tray 81 from an unused state (upright position) to a used state (horizontal position). A user's hand is inserted into the handle portion 824 to open the exterior unit 82 with respect to the conveyance guide unit 83 for example when a jam has occurred between the exterior unit 82 and the conveyance guide unit 83. The exterior unit 82 is configured to be turnable about its right end as a pivot axis. Through the opening 825, air is taken from the outside to the inside of the housing 10 (see FIG. 1) and discharged from the inside to the outside of the housing 10.

Figure 6:
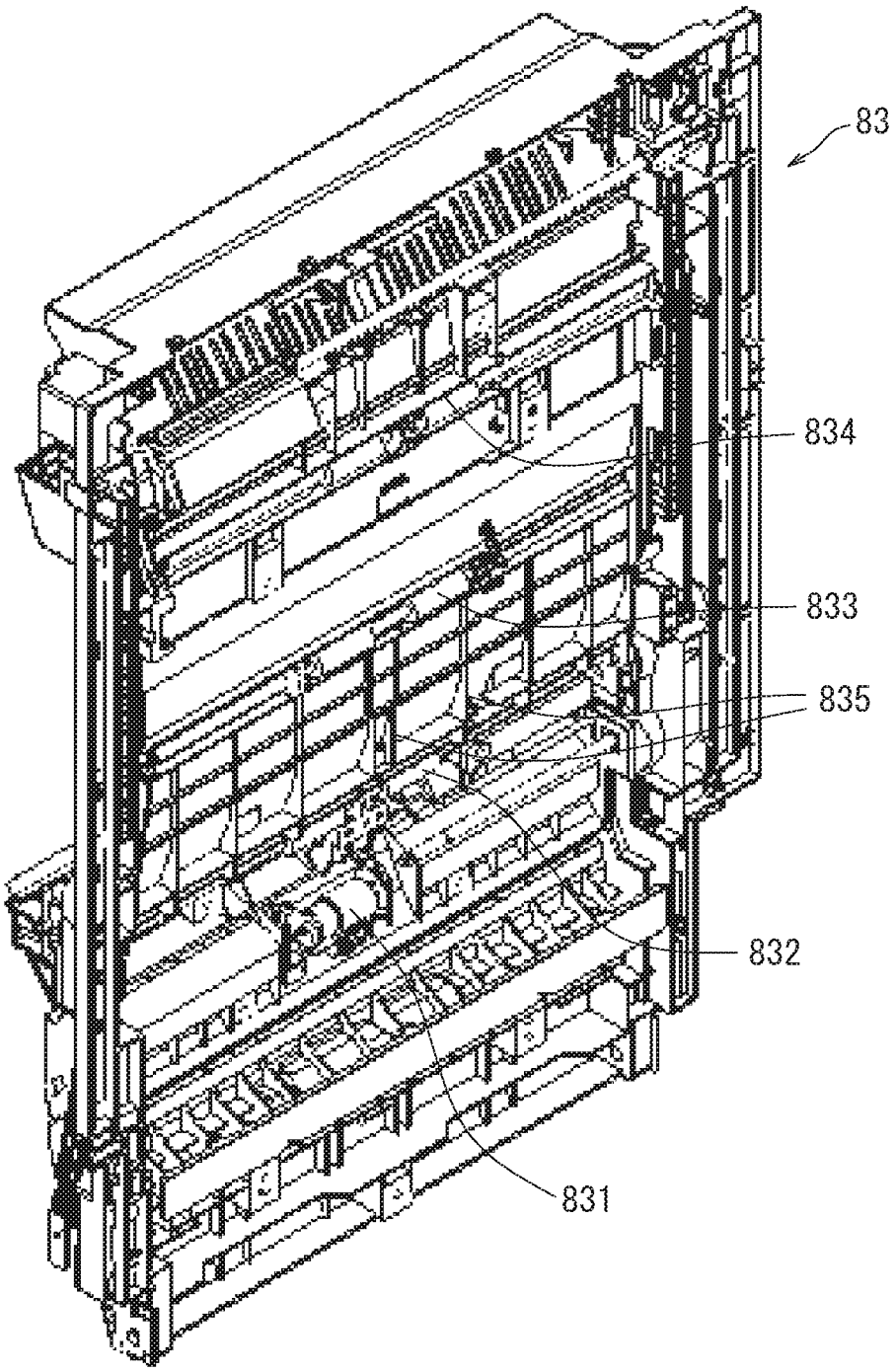
FIG. 6 is a perspective view illustrating a configuration of a conveyance guide unit illustrated in FIG. 4.

Next, a configuration of the conveyance guide unit 83 will be described with reference to FIG. 6. FIG. 6 is a perspective view illustrating the configuration of the conveyance guide unit 83. The conveyance guide unit 83 further includes conveyance rollers 832, 833, and 834, and conveyance guides 835 in addition to the retard roller 831.

The conveyance rollers 832, 833, and 834 are located in the conveyor device L (see FIG. 1) and convey paper P. In the exterior unit 82 illustrated in FIG. 5, conveyance rollers are located at positions opposite to the conveyance rollers 832, 833, and 834 of the conveyance guide unit 83.

The conveyance guides 835 guide paper P conveyed between the conveyance roller 832 and the conveyance roller 833. Specifically, the conveyance guides 835 each are a plate-shaped member standing on a casing constituting the conveyance guide unit 83 in a conveyance direction of the paper P (vertical direction in FIG. 6). A plurality of the conveyance guides 835 are arranged in the width direction (left-right direction in FIG. 6). In the exterior unit 82 illustrated in FIG. 5, conveyance guides are located at positions opposite to the conveyance guides 835 of the conveyance guide unit 83.

Figure 7:
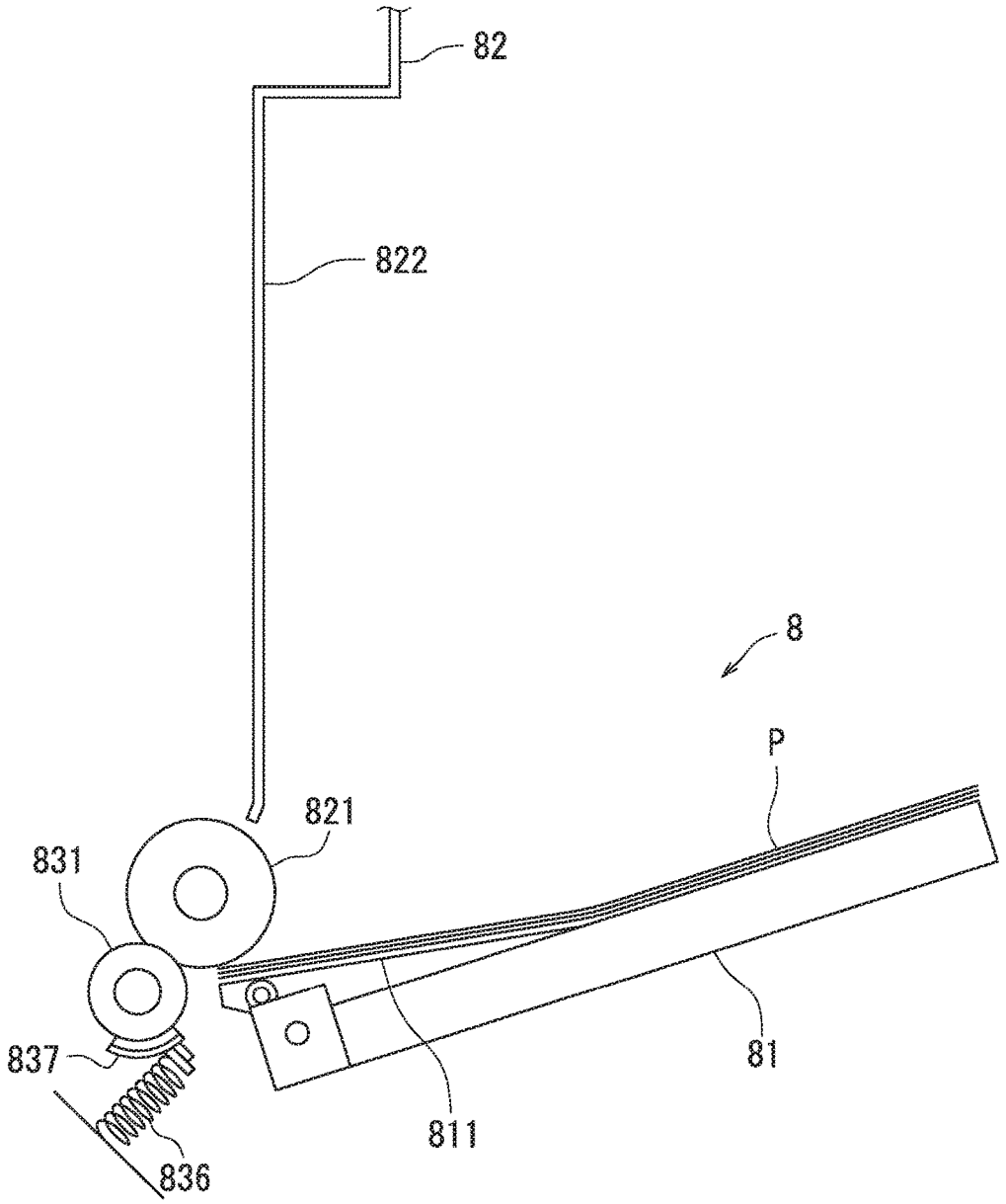
FIG. 7 is a side view illustrating a configuration of the main part of the manual paper feed section illustrated in FIG. 4.

Next, a configuration of the main part of the manual paper feed section 8 will be described with reference to FIG. 7. FIG. 7 is a side view illustrating the configuration of the main part of the manual paper feed section 8. The manual feed tray 81 includes a lift plate 811. The lift plate 811 is driven by a motor not illustrated and lifted up at the time of paper feeding to press the upper most sheet of paper P against the paper feed roller 821.

When the exterior unit 82 is mounted on the conveyance guide unit 83, the circumferential surface of the paper feed roller 821 located in the exterior unit 82 comes in contact with the circumferential surface of the retard roller 831 located in the conveyance guide unit 83. A spring 836 and a pressing member 837 are also located in the conveyance guide unit 83. The spring 836 presses the retard roller 831 against the paper feed roller 821 via the pressing member 837.

The paper feed roller 821 is driven to rotate at all time by a motor not illustrated. The retard roller 831 normally rotates in a direction reverse to a rotational direction of the paper feed roller 821, and rotates in the same direction as the rotational direction of the paper feed roller 821 according to a load applied to a torque limiter not illustrated.

When plural sheets of paper are fed between the paper feed roller 821 and the retard roller 831, force is applied to a sheet of the paper in contact with the retard roller in a direction reverse to a direction in which force is applied to another sheet of the paper in contact with the paper feed roller 821. Through the above, the sheet of the paper in contact with the retard roller 831 is separated from the sheet of the paper in contact with the paper feed roller 821.

As described above, members constituting the manual paper feed mechanism (the paper feed roller 821, the retard roller 831, the spring 836, and the pressing member 837) that performs manual paper feeding are located in the conveyance guide unit 83 or the exterior unit 82. Therefore, space-saving around the manual paper feed mechanism is achieved.

Further, the members constituting the manual paper feed section 8 include the paper feed roller 821 that feeds paper from the manual feed tray 81 to the conveyor device L, and the paper feed roller 821 is located in the exterior unit 82. Therefore, space-saving around the manual paper feed mechanism is achieved with a simple configuration.

Further, the paper feed roller 821 is located at a position corresponding to a central part of the paper P in the width direction thereof. Also, the paper feed roller 821 has a width smaller than that of the paper P. Therefore, space-saving around the manual paper feed mechanism is achieved with a simple configuration.

Further, the members constituting the manual paper feed section 8 include the retard roller 831 that separates sheets of the paper P. The retard roller 831 is located in the conveyance guide unit 83. Therefore, space-saving around the manual paper feed mechanism is achieved with a simple configuration.

Further, the retard roller 831 is located at a position corresponding to the central part of the paper P in the width direction thereof. Also, the retard roller 831 has a width smaller than that of the paper P. Therefore, space-saving around the manual paper feed mechanism is achieved with a simple configuration.

Through the above, the embodiment of the present invention has been described with reference to the drawings. However, it should be noted that the present invention is not limited to the above embodiment and is practicable in various manners within the scope not departing from the gist of the present invention (for example, as described below in sections (1) to (5)). The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Furthermore, properties of the elements of configuration described in the above embodiment, such as shapes and dimensions, are merely examples and are not intended as specific limitations. Various alterations may be made so long as there is no substantial deviation from the configuration of the present invention.

(1) In the above-described embodiment, the paper feed roller 821 is located in the exterior unit 82. However, in a configuration, the paper feed roller 821 may be located in the conveyance guide unit 83.

(2) In the above-described embodiment, the retard roller 831 is located in the conveyance guide unit 83. However, in a configuration, the retard roller 831 may be located in the exterior unit 82.

(3) In the above-described embodiment, the retard roller 831 serves as a separating roller that separates sheets of paper P fed by the paper feed roller 821. However, in a configuration, another type of separating roller may be used.

(4) In the above-described embodiment, the paper feed roller 821 has a width smaller than that of the paper P. However, in a configuration, the paper feed roller 821 may have a width substantially the same as that of the paper P.

(5) In the above-described embodiment, the retard roller 831 has a width smaller than that of the paper P. However, in a configuration, the retard roller 831 may have a width substantially the same as that of the paper P.

INDUSTRIAL APPLICABILITY

The present invention is applicable to an image forming apparatus.

The invention claimed is:

1. An image forming apparatus that performs image formation on a recording medium, comprising:

an image forming device configured to form an image on the recording medium;

a conveyor device configured to convey the recording medium; and a manual paper feed mechanism configured to perform manual paper feeding, wherein a part of the conveyor device is constituted by a conveyance guide unit and an exterior unit, the exterior unit is located opposite to the conveyance guide unit and constitutes a part of an exterior surface of the image forming apparatus, the manual paper feed mechanism is located in the conveyance guide unit or the exterior unit, the image forming apparatus further comprising members that constitute the manual paper feed mechanism, the members including a paper feed roller that feeds the recording medium to the conveyor device, the paper feed roller is located in the exterior unit, the members that constitute the manual paper feed mechanism include a separating roller that separates recording mediums fed by the paper feed roller, and the separating roller is located in the conveyance guide unit.

2. The image forming apparatus according to claim 1, wherein the paper feed roller is located at a position corresponding to a central part of the recording medium in a width direction thereof, and the paper feed roller has a width smaller than that of the recording medium.

3. The image forming apparatus according to claim 1, wherein the separating roller is located at a position corresponding to a central part of the recording medium in a width direction thereof, and the separating roller has a width smaller than that of the recording medium.

4. The image forming apparatus according to claim 1, wherein the separating roller is a retard roller.

5. The image forming apparatus according to claim 1, wherein the members that constitute the manual paper feed mechanism include a manual feed tray on which the recording medium is placed, the exterior unit includes a tray accommodating space, and the tray accommodating space accommodates the manual feed tray.

6. The image forming apparatus according to claim 5, wherein the manual feed tray includes a lift plate, and the lift plate presses the recording medium placed on the manual feed tray against the paper feed roller in paper feeding.

* * * * *